US005692972A

United States Patent [19]

Langslet

[11] Patent Number: 5,692,972

[45] Date of Patent: Dec. 2, 1997

[54] VIBRATIONALLY DAMPED GOLF CLUB HEAD

[76] Inventor: Eric B. Langslet, 4 Hilton Pl., Montvale, N.J. 07645

[21] Appl. No.: 625,767

[22] Filed: Mar. 29, 1996

[51] Int. Cl.[6] ..... A63B 53/04

[52] U.S. Cl. ..... 473/332; 473/340; 473/345; 473/350; 473/346

[58] Field of Search ..... 473/345, 346, 473/332, 350, 338, 349, 291, 226, 219, 256, 340

[56] References Cited

U.S. PATENT DOCUMENTS

| | | | |
|---|---|---|---|
| D. 318,087 | 7/1991 | Helmstetter . | |
| D. 341,177 | 11/1993 | Yamada . | |
| D. 343,665 | 1/1994 | Feche et al. . | |
| D. 344,997 | 3/1994 | Allen . | |
| 2,307,193 | 4/1943 | Bellis . | |
| 2,846,228 | 8/1958 | Reach | 473/332 |
| 3,567,228 | 3/1971 | Lynn . | |
| 4,076,254 | 2/1978 | Nygren . | |
| 4,730,830 | 3/1988 | Tilley . | |
| 4,869,507 | 9/1989 | Sahm | 473/337 |
| 4,928,972 | 5/1990 | Nakanishi | 473/332 |
| 5,154,424 | 10/1992 | Lo | 473/338 |
| 5,290,036 | 3/1994 | Fenton | 473/332 |
| 5,316,298 | 5/1994 | Hutin et al. . | |
| 5,409,229 | 4/1995 | Schmidt et al. . | |
| 5,411,255 | 5/1995 | Kurashima et al. . | |
| 5,415,405 | 5/1995 | Vincent . | |
| 5,419,559 | 5/1995 | Melanson et al. . | |
| 5,431,401 | 7/1995 | Smith | 473/338 |
| 5,492,327 | 2/1996 | Biafore | 473/332 |

OTHER PUBLICATIONS

Senior Golfer (Mar., 1997).

1997 Dunlop Product Catalog (1997).

*Primary Examiner*—Sebastiano Passaniti

*Attorney, Agent, or Firm*—Klauber & Jackson

[57] ABSTRACT

A golf club head which has a club head body, a means to attach the club head body to a shaft, a striking face wall to address a ball during a golf club stroke and a bottom surface adapted to pass adjacent the ground during the golf club stroke, includes a vibration damping member of shock-absorptive material disposed within said club head body and extending in a plane outside the plane containing said striking face wall. The vibration damping member is preferably disposed either substantially perpendicular to said striking face wall or substantially parallel to said bottom surface. The damping member preferably abuts the striking face wall without penetrating therethrough.

30 Claims, 3 Drawing Sheets

VIBRATIONALLY DAMPED GOLF CLUB HEAD

BACKGROUND OF THE INVENTION

The present invention relates to golf club heads generally and, more particularly, but not by way of limitation, to a novel vibrationally damped golf club head.

DESCRIPTION OF THE RELATED ART

The present invention concerns vibrationally damped golf club heads, whether the golf club head has the shape and function of a "wood", an iron, or a putter. Furthermore, the invention is applicable to golf club heads of "woods", whether the head is composed of a traditional woody material, such as persimmon, or the so-called metal wood. For ease of reference, it should be understood that the term "driver" corresponds to all manner of "woods" and irons. The term "putter" corresponds to all manner of putting clubs. More generally, the term "club" includes both drivers and putters.

Whenever a golfer swings a club and hits a golf ball, the impact between the club head and the ball creates considerable force. Ideally, most of the energy is transmitted from the club head to the ball. However, unwanted vibrations emanate from the point of impact and are transmitted from the club head, up through the shaft, and into the golfer's body. These vibrations are particularly evident when the ball is not hit cleanly with the club head. The vibrations which are transmitted to the golfer's body result in fatigue, discomfort, distraction, and the possibility of injury. Golfers sometimes experience soreness in the fingers, hands, wrists, elbows, and/or shoulders. The soreness can approach the severity of the syndrome known as "tennis elbow". Such a condition is particularly exacerbated during practice sessions when hundreds of balls are repetitively hit.

Numerous modifications in construction of golf club heads can be found in the prior art. U.S. Pat. No. 2,307,193 issued to Bellis on Jan. 5, 1943 shows a golf club head constructed of layers of plywood provided with notches which receive a sheet-like rubber insert. The object of the Bellis golf club head is to provide a resilient striking face, a reinforced head resistant to tension, compression, and splitting, and to provide an improved appearance. The Bellis patent does not teach or even suggest any vibrational damping qualities provided by such construction.

U.S. Pat. No. 3,567,228 issued to Lynn discloses a rod extending from the face plate to the rear club wall. The golf club's striking face and weight distribution arrangement are intended to increase the capacity of the golf club to hit a golf ball over greater distances with improved accuracy. U.S. Pat. No. 4,076,254 issued to Nygren similarly discloses a metal insert which is encased in a plastic matrix disposed within the golf club head. The Nygren head is intended to concentrate the mass at a maximum distance from the club face to provide a maximum moment of inertia, and to concentrate the mass behind the hitting area while maintaining the same total weight by using a low density material for the head's exterior surface. Furthermore, U.S. Pat. No. 4,730,830 issued to Tilley shows a golf club head having a hollow head filled with a filling material formed with a multiplicity of bores which can receive weights to achieve a desired weight and balance of the hollow head.

Other patents have addressed the issue of dampening sound vibrations emanating from the golf club head, as illustrated in U.S. Pat. No. 5,409,229 issued to Schmidt et al. and U.S. Pat. No. 5,419,559 issued to Melanson et al.

Schmidt et al. provide an audible vibration attenuating means disposed on the outer rear wall of the golf club head. Melanson et al. provide sound dampening with a web secured to the inner surface of the crown inside the head, contacting the inner surface of the striking face and extending rearwardly short of the inner face of the rear wall.

U.S. Pat. No. 5,316,298 issued to Hutin et al. provides a vibration damping means located on the outer rear wall of an iron or within the cavity of a wood. U.S. Pat. No. 5,411,255 issued to Kurashima et al. discloses a metallic golf club head having a hollow chamber portion and either a sheet body or a coating material having vibration restraining characteristics which are made of a heat setting resin or rubber covered by metallic foil. The sheet body is attached to an inner surface of the metallic head.

A principal object of the invention is to provide a vibrationally damped golf club head. Another object is to provide a damping means disposed within the interior of the golf club head. A further object is to provide a vibration damping means which does not penetrate beyond the outer surfaces of the conventional golf club head.

It is yet another object of the present invention to provide a vibration damping means compatible with the heads of drivers and putters. A still further object is to provide a vibrationally damped golf club head which is rugged and durable. Yet another object is to provide a vibrationally damped golf club head which has a replaceable vibration damping means. Another object is to provide a vibrationally damped golf club head which is easily and economically constructed.

An additional object of the present invention is to provide a method for vibrationally damping a golf club head. Yet another object is to provide a vibrationally damped golf club head which has no moving parts. Another object is to provide a vibrational damping means which is disposed within the golf club head and which extends which fully extends to an outside perimeter of the golf club head. A further object is to provide a vibration damping means that can be inserted into a golf club head made of metal, wood, graphite, KEVLAR™, or any other material from which golf club heads are made.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a particular embodiment, a vibrationally damped golf club head.

The golf club head which has a club head body, a means to attach the club head body to a shaft, a striking face wall to address a ball during a golf club stroke and a bottom surface adapted to pass adjacent the ground during the golf club stroke, includes a vibration damping member of shock-absorptive material disposed within the club head body and extending in a plane outside the plane containing the striking face wall.

The vibration damping member may be disposed either substantially perpendicular to the striking face wall or substantially parallel to the bottom surface. The damping member preferably abuts the striking face wall without penetrating therethrough, although the member may penetrate the striking face wall until flush with that wall.

The striking face wall typically has an impact area disposed substantially in the center of the striking face wall and a non-impact area disposed outside the impact area. The plane of the vibration damping member preferably intersects the non-impact area.

The vibration damping means preferably further comprises at least one thin flexible layer of shock-absorptive material.

The vibration damping member may be secured within the golf club head by a fastening means. The fastening means may be an adhesive means disposed about the vibration damping member, wherein a first layer of adhesive is disposed upon a first surface of the vibration damping member and a second layer of adhesive disposed upon a second surface. The adhesive may be a glue, an epoxy, or a double faced adhesive strip. The fastening means may further comprise a screw means for securing the vibration damping member through the bottom surface, which may include at least one screw. The screw means may further comprise at least one hollow screw receptacle fixedly disposed within the club head body. The hollow screw receptacle may be threaded to receive a respective screw.

One type of club head body is made from a sealed hollow shell. Such a shell may be filled with a foam plastic encasing material disposed within the interior of the sealed hollow shell. The golf club body may then further include a removable sole plate and an upper body portion, wherein the vibration damping member is disposed between the removable sole plate and the upper body portion.

Furthermore, the present invention achieves the above objects, among others, by providing, in a particular embodiment, a method of vibrationally damping a golf club head which includes: (a) integrally forming the club head body to include an upper head portion and a bottom portion connected by the front striking face wall, wherein the upper head portion, bottom portion and front striking face wall define a backwardly extending slot; (b) applying adhesive to a vibration damping element; (c) inserting the vibration damping element into the slot allowing the damping element to cure.

Another method of vibrationally damping a golf club head includes the steps of: (a) making a cut into the club head body which abuts the striking face wall without penetrating therethrough; (b) injecting a vibration damping material into the cut; (c) allowing the damping material to cure.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
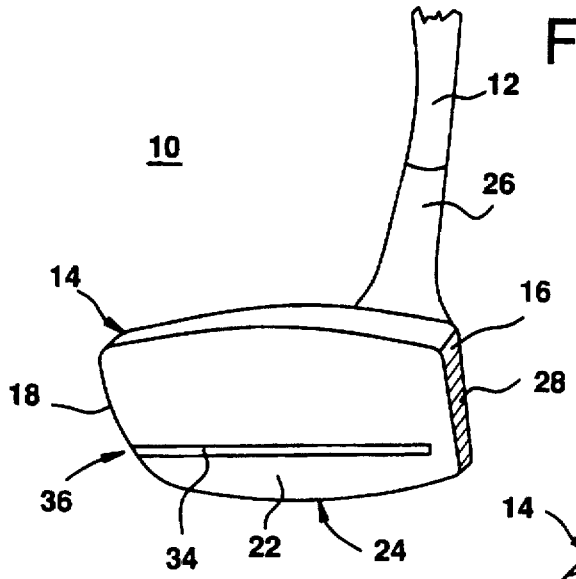
FIG. 1 is a side perspective view of a vibrationally damped golf club head viewed from the toe portion, in accordance with the present invention.
Figure 2:
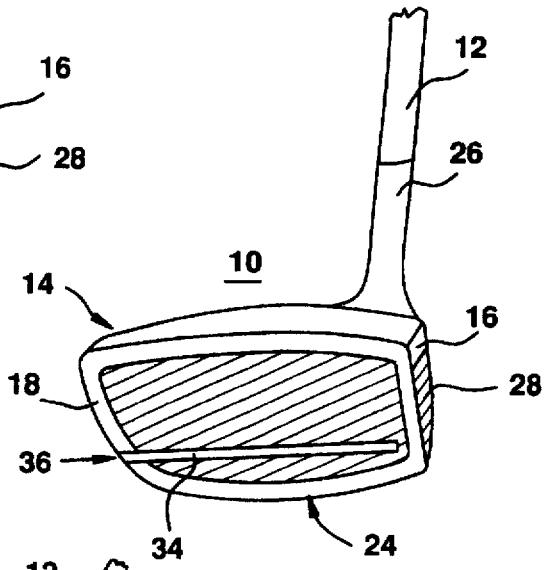
FIG. 2 is a side cutaway perspective view of the vibrationally damped golf club head of FIG. 1.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

FIG. 1 illustrates a first embodiment of a vibrationally damped golf club head according to the present invention, generally indicated by the reference numeral 10. Head 10 is attached to a golf club shaft 12.

It should be understood that the vibrationally damped golf club head 10 as contemplated by the present invention may have the shape, function, and characteristics of a "wood", an iron, or a putter. The head 10 is applicable to "woods", whether the head is of the traditional woody material variety, such as those made of persimmon, or the so-called "metal wood" variety. For ease of reference, it should be understood that the term "driver" as used herein corresponds to all manner of "woods" and irons. The term "putter" corresponds to all manner of putting clubs. More generally, the term "club" includes all manner of drivers and putters, and the present invention is equally applicable to any golf club head, including drivers and putters.

As seen in the Figures, a golf club head 10 includes a club head body 14 having a face portion 16, a back portion 18 disposed opposite the face portion 16, a heel portion 20 disposed between the face 16 and back 18 portions and adapted to attach to the shaft 12, a toe portion 22 disposed opposite the heel portion 20 and between the face and back portions 16, 18, and a bottom surface 24, or "sole". The toe portion 22 points away from a golfer when addressing a golf ball and during a swing. The bottom surface 24 generally lies substantially parallel to the ground during address, and passes adjacent the ground during the golf club stroke. The face portion 16 is typically substantially flat, although it may be convex and may include a rounded periphery. Similarly, the bottom surface 24 or sole is typically substantially flat, possibly possessing some concavity and/or a rounded periphery. The golf club head 10 also includes a means for attachment to a golf club shaft, sometimes referred to as the hosel 26.

Figure 3:
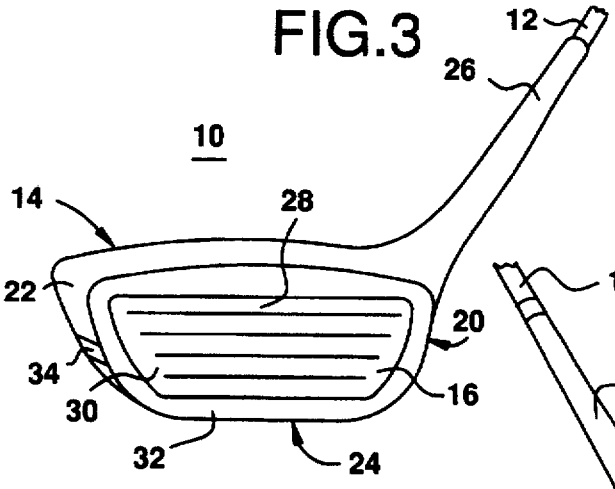
FIG. 3 is a front perspective view of the vibrationally damped golf club head of FIG. 1.
Figure 4:
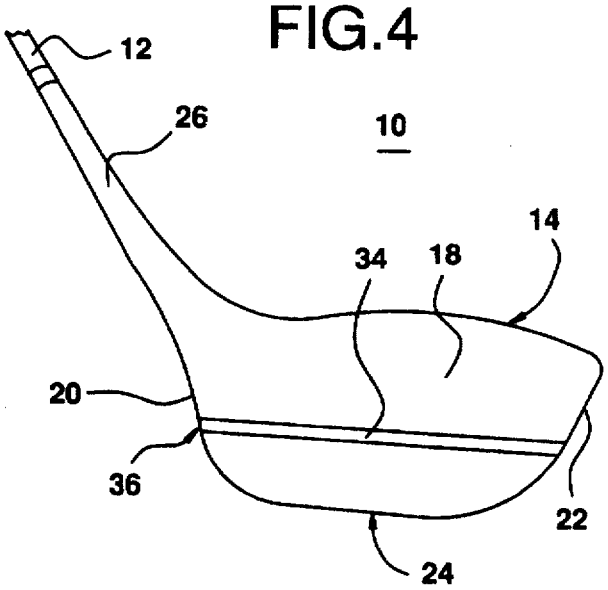
FIG. 4 is a back perspective view of the vibrationally damped golf club head of FIG. 1.
Figure 5:
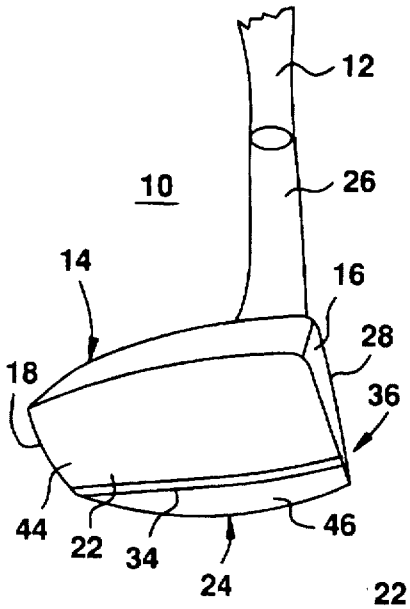
FIG. 5 is a side perspective view of an alternate embodiment of the vibrationally damped golf club head of the invention, viewed from the toe portion.
Figure 6:
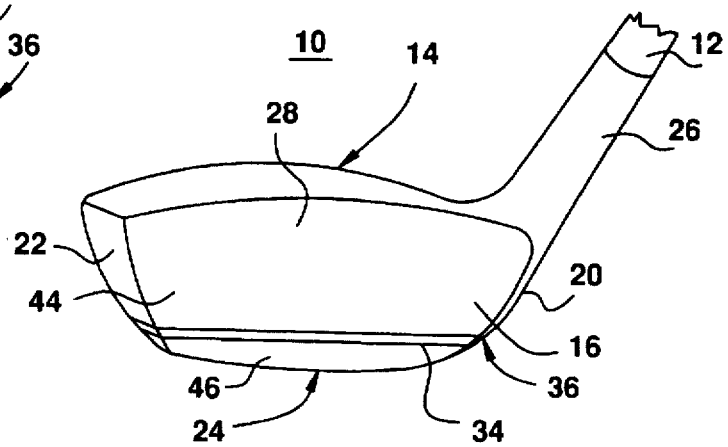
FIG. 6 is a front perspective view of the vibrationally damped golf club head of FIG. 5, viewed from the front face wall.

As best seen in FIG. 3, a striking face wall 28 is disposed on the face portion 16 of the body 14. The striking face wall 28 addresses the golf ball before a swing and contacts the ball during the swing. The striking face wall 28 typically has an impact area 30 where impact with the ball is intended, as described, for example, in the Rules of the United States Golf Association. The impact area 30 is typically disposed substantially in the center of the striking face wall 28, and encompasses less than the total area of the striking face wall or front face wall 28. The remaining area on the front wall 28 may be referred to as the non-impact area 32, which would typically lie outside the impact area 30 or "sweet spot" of the head 10, and is disposed around the periphery or part of the periphery of the impact area 20.

A vibration damping member 34 is disposed within the club head body 14, as depicted in the embodiment of FIGS. 1–4, and in the second embodiment of FIGS. 5–8. The vibration damping member 34 is composed of shock-absorptive material which dampens or attenuates vibrations generated when the golf club head 10 impacts a solid object like a golf ball tee, ground, grass, sand, or golf hazard. The damping member 34 also serves to reduce or substantially eliminate vibrations which are generated by slightly off-center contact between the ball and the striking face, or even when a ball is hit "dead solid perfect". The mechanical vibrations which are dampened include acoustical vibrations or unwanted noises which are generated upon impact.

The vibration damping member 34 is preferably made of natural or synthetic rubber or the like, and may be composed of a shock-absorbing material such as a thermosetting resin, a thermosetting plastic, a urethane, a composite material, wood, cork, graphite, KEVLAR® or other material which has vibration dampening characteristics. The damping member 34 may also be fabricated from a relatively soft metal, such as brass. Moreover, the damping member 34 may be encased in a hollow shell or sac. The hollow shell or sac may be filled with a liquid or a gel or a waxy substance.

Preferably, the vibration damping member 34 extends in a plane which is outside the plane containing the striking face wall 28. The vibration damping member 34 is preferably disposed substantially perpendicular to the front striking face wall 28 or substantially parallel to the bottom surface 24. The present invention also contemplates damping elements 34 which are disposed at an incline, or on an inclined plane, with respect to one or more surfaces of the club head body 14, which surfaces include the striking face wall 28, the bottom surface 24, or other surfaces. Thus, the vibration damping member 34 need not lie substantially perpendicular to the front striking face wall 28 or substantially parallel to the bottom surface 24 in order to achieve desired objectives. It should be understood that the vibration damping member 34 could lie within the inner portion of the club head body 14 at any orientation. For example, the damping plane may lie substantially parallel to the front face wall 28 in a vertical orientation.

It should be further understood that the vibration damping member 34 may not necessarily extend all the way throughout the damping plane within the boundaries of the outer surface of the head 10, but may occupy a lesser portion thereof.

In the second embodiment shown in FIGS. 4–8, the vibration damping member 34 preferably extends throughout the inner portion of the club head body 14, and lies substantially along a damping plane intercepting the head 18.

In the embodiment of FIGS. 1–4, the vibration damping member 34 abuts the striking face wall 28 without penetrating therethrough. In the second embodiment of FIGS. 5–8, the vibration damping member 34 penetrates the striking face wall 28 until flush with that wall. In both embodiments, the plane of the vibration damping member 34, or the vibration damping member itself, may intersect the striking face wall 28 in the non-impact area 32. The vibration lessening member 31 may be placed to conform with applicable rules of golf, such as those of the United States Golf Association.

The damping member 34 preferably comprises one or more thin flexible layers of shock-absorbing material.

It should be understood that the present invention may provide more than one vibration damping member 34 within the club head body 14 to achieve the desired damping.

Although the vibration damping member 34 is preferably a substantially planar, thin damping element, the present invention also contemplates thicker elements, and elements which are curved or slanted, as well as elements which have a cylindrical shape. Moreover, the present invention contemplates a damping member 34 which may lie entirely within all of the outer surfaces of the club head body 14 without penetrating therethrough. Furthermore, the present invention contemplates a damping member 34 which penetrates through one or more surfaces of the club head body 14 without penetrating one or more remaining surfaces, e.g. the vibration damping member 34 may abut the heel portion 20, toe portion 22 and striking face wall 28 without penetrating therethrough while extending to and penetrating through the back portion 18 of the club head body 10.

Alternately, a distal edge of the damping member 34 could extend outwardly until nearly flush with the outer surface, such that the head 10 and the distal edge define a peripheral recess in the outer surface of the head 10. The head may then further comprise a filler means for filling in the peripheral recess with a filler material, for example, until the filler material is flush with the outer surface of the head. The filler may be an epoxy, putty, or other filler material which is durable and resilient enough to withstand the impact between the head and golf balls.

Although the vibration damping member 34 preferably comprises one thin flexible layer of material, the member could alternately be comprised of multiple layers of material. The layers may be disposed such that they abut each other, or such that they are distributed throughout the inner portion of the club head body on various planes and/or at various orientations.

The vibration damping member 34 is securely attached to the club head body 14 such that the damping member 34 can withstand repeated impacts without dislodging from the inside the golf club head 10. The damping member 34 may be press fitted into a hole or slot in the club head body. The hole or slot may also be a slit, bore, recess, cavity or other opening. The damping member 34 may be cooled or frozen before insertion into the club head body 14, and then inserted, whereupon the member 34 would warm up to room temperature or the like and expand to firmly fill voids in the club head body near the vibration damping member 34 thereby fitting securely within the club head body.

The vibrationally damped golf club head 10 may include a fastening means 36 for securing the damping member 34 securely within the golf club head 10. The fastening means 36 may be an adhesive means disposed about the damping member. The adhesive means may be disposed between the golf club body 14 and one or more outer surfaces of the member 34. The adhesive means preferably includes a first layer of adhesive disposed on a first surface of the damping member, and a second layer of adhesive on a second surface of the member. The adhesive means may include glue, epoxy, double faced adhesive stripping, or other well known adhesives.

The securement of the damping member 34 in the embodiment may be accomplished as mentioned above, either singly or in various combinations. For example, a damping element 34 may be frozen, an epoxy applied to one or more of its surfaces, then inserted into the club head body and allowed to heat up, expand and cure.

Figure 7:
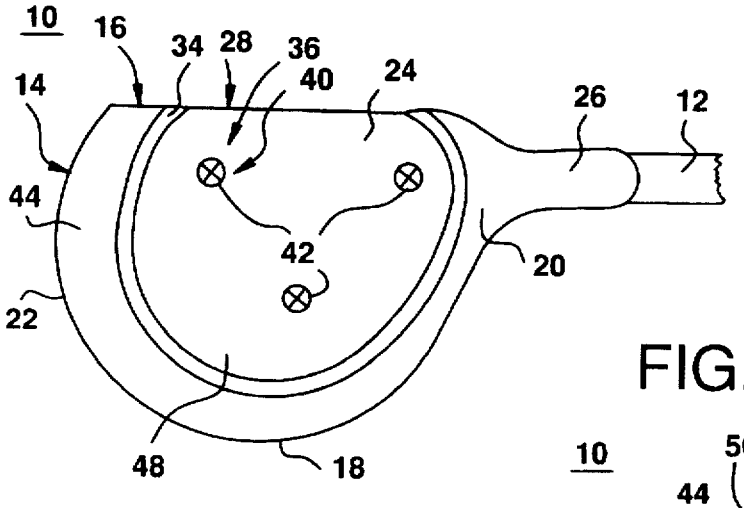
FIG. 7 is a bottom perspective view of the vibrationally damped golf club head of FIG. 5.

The fastening means 36 may also comprise a screw means 40 which includes at least one screw 42, as seen in FIGS. 7 and 8. In the second embodiment, the screw means 40 preferably passes through the sole or bottom surface 24 of the golf club head 10, although the screw means 40 may enter the club head body 14 through any outer surface of the club head body 14. The screw means 40 preferably enters the club head body 14 perpendicularly, although entry may be made at another angle.

In the second embodiment, the golf club head 10 further comprises an upper body portion 44 and a sole plate 46 which forms the bottom surface 24 of the club head body 14, with the vibration damping member 34 disposed therebetween. The sole plate 46 may be removable such that extraction of the screw means 40 from the club head body 14 releases the sole plate 46 from the body 14. Thus, the damping member may be removed and replaced.

The screw means 40 may be driven into the club head body 14 where the body is solid and made of wood or metal, e.g. the traditional "wood" or the metal irons and putters, or other synthetic or composite materials, e.g. urethane. Club head bodies 14 may also be comprised of a sealed hollow shell 48 having an inner cavity 50, some of which bodies further comprise an encasing material 52, e.g. foam plastic, which fills up the inner cavity 50 of the sealed hollow shell 48.

Figure 8:
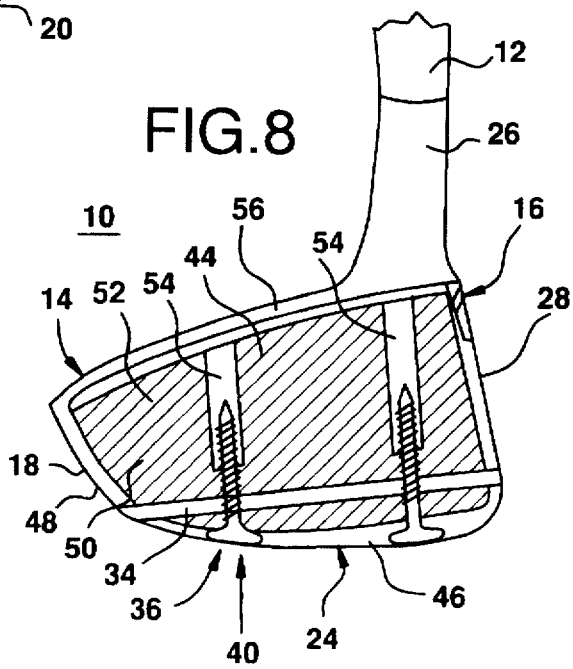
FIG. 8 is a side cutaway view of the vibrationally damped golf club head of FIG. 5, of the metal wood type.

As seen in the embodiment of FIG. 8, the screw means 40 may further preferably comprise at least one hollow screw receptacle 54 which is fixedly disposed within the club head body 14 for receiving the at least one screw 42. The hollow screw receptacle 54 may be threaded to receive the screw 42. The receptacles 54 preferably depend from the top wall 56 of the hollow shell 48, and the receptacles 54 may be welded to the top wall 56 or preferably integrally formed therewith, e.g. as in a single casting mold. The receptacles 54 may also be fixedly disposed within the interior of the club head body 14 if the interior of the body is composed of a solid material capable of supporting the receptacle 54, the damping member and the sole plate, in which case the receptacles 54 may be fixedly attached to the interior of the club head body 14 by adhesive, press fit means, or other affixing means. The hollow screw receptacle 54 could be made from metal, plastic, or other suitable material.

It should be understood that the embodiment illustrated in FIGS. 1–4, may further comprise a screw means 40 as described above as a second embodiment such that the fastening means 36 includes both an adhesive means and a screw means 40. Similarly, the second embodiment may employ an adhesive means in addition to a screw means.

The adhesive may be a glue, an epoxy, double faced adhesive strip, or other suitable adhesive known in the art. It should be understood that the adhesive means could be used in conjunction with the screw means to provide additional securement in other embodiments.

The vibration damping member 34 may be composed of a material wherein the damping member 34 itself provides the fastening means. The material would have the characteristics of: possessing an adhesive surface, curing, and forming a connective bond between the vibration damping member 34 and the club head body 14. By way of example, the vibration damping member 34 may be composed of an elastomeric material, and the club head body 14 may be composed of a metal alloy. The damping member 34 would be inserted into a slot, slit, cavity, bore, hole or recess in the club head body 14, then raised to a selected bonding temperature which enhances the adhesive quality of the outer surface of the damping member. The head is then allowed to cool and cure, thus forming a connective bond between the members.

Alternately, the vibration damping material may be injected into the opening in the club head body 14, if, for example, the damping material is a thermosetting resin, plastic or waxy substance, or a gel. The opening may then be sealed with a sealing filler material or a plug.

The club head body 14 may be pre-fabricated with a slot, slit, hole, cavity, bore, recess, or other opening which serves as a damping member receiving means thereby obviating the need to make a cut in the club head body 14.

Furthermore, the vibration damping material 34 may be cooled or frozen at a low temperature such that the material contracts in size before insertion into the club head body 14. When the temperature of the vibration damping material 34 is raised above the low freezing temperature, the material will expand slightly to firmly fill small voids within the club head 10 near the vibration damping material 34.

Figure 9:
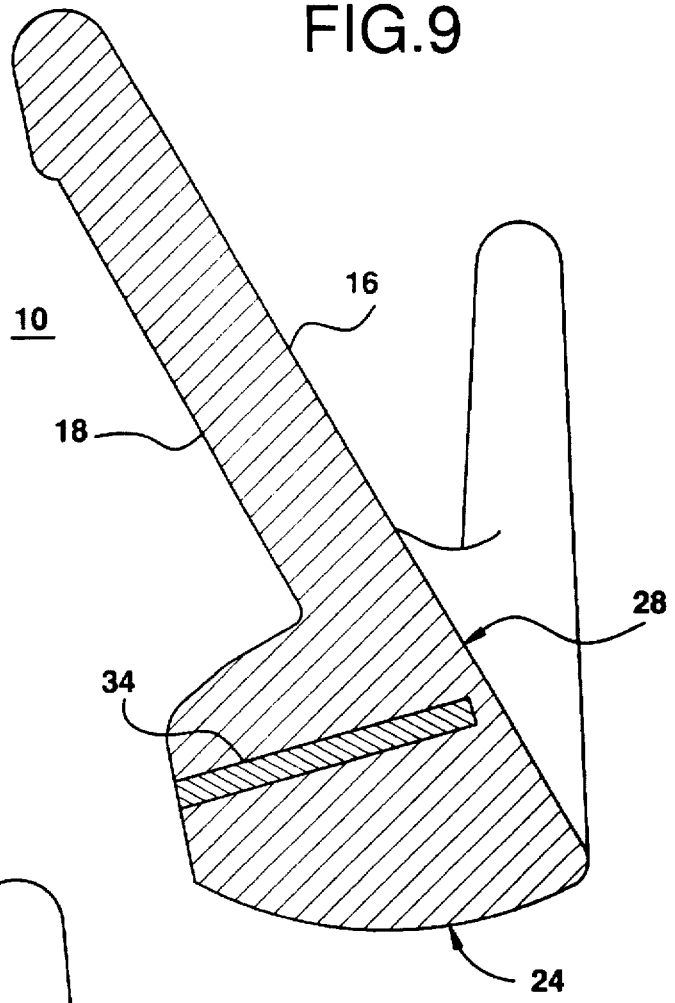
FIG. 9 is a cutaway isometric view of a vibrationally damped iron-type golf club head according to the present invention.

FIG. 9 shows an embodiment of a vibrationally damped iron-type golf club head according to the present invention.

Figure 10:
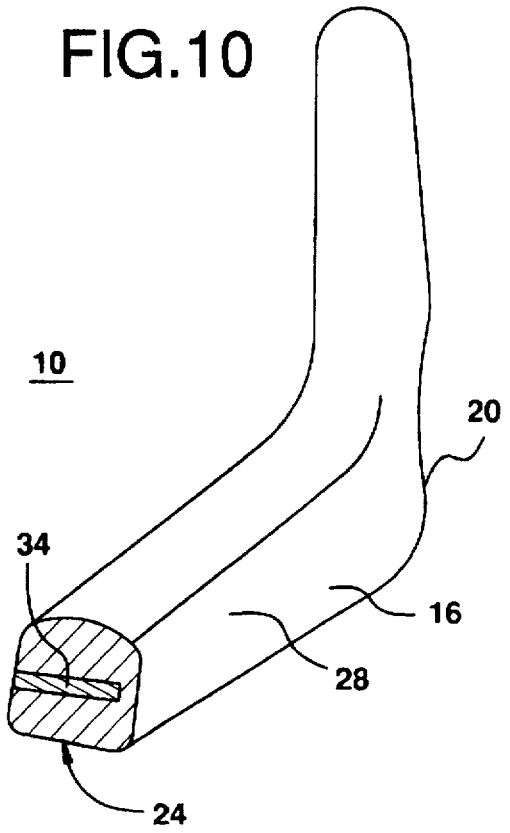
FIG. 10 is a cutaway isometric view of a virbationally damped gutter golf club head according to the present invention.

FIG. 10 shows an embodiment of a vibrationally damped putter according to the present invention.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A golf club head comprising:

a club head body, having:

a plurality of outer walls including a striking face wall with an outer surface to address a ball during a golf club stroke and a bottom wall adapted to pass adjacent the ground during the golf club stroke, and at least one generally planar cavity disposed within the interior of said club head body and extending generally rearwardly in a plane outside the plane containing the outer surface of said striking face wall; and a shock-absorptive vibration damping member, disposed within said cavity;

wherein said vibration damping member substantially fills said cavity.

2. A golf club head according to claim 1 wherein said vibration damping member is disposed substantially perpendicular to striking face wall.

3. A golf club head according to claim 1 wherein said vibration damping member is disposed substantially parallel to said bottom wall.

4. A golf club head according to claim 1 wherein said vibration damping member abuts the interior of the striking face wall without penetrating therethrough.

5. A golf club head according to claim 1 wherein said vibration damping member penetrates the striking face wall until adjacent the outer surface of the striking face wall.

6. A golf club head according to claim 1 wherein said striking face wall further comprises:

an impact area disposed substantially in the center of the outer surface of the striking face wall; and a non-impact area disposed on the outer surface of the club head body outside the impact area;

wherein the peripheral edge of said vibration damping member intersects the non-impact area.

7. A golf club head according to claim 1 wherein said vibration damping means further comprises at least one thin flexible layer of shock-absorptive material.

8. A golf club head according to claim 1 further comprising a fastening means for securing said vibration damping member securely within said golf club head.

9. A golf club head according to claim 8 wherein said fastening means further comprises an adhesive means disposed about said vibration damping member.

10. A golf club head according to claim 9 wherein said adhesive means further comprises a first layer of adhesive disposed upon a first surface of said vibration damping member and a second layer of adhesive disposed upon a second surface of said vibration damping member.

11. A golf club head according to claim 10 wherein said adhesive is a glue, an epoxy, or a double faced adhesive strip.

12. A golf club head according to claim 8 wherein said fastening means further comprises a screw means for securing said vibration damping member through said bottom surface.

13. A golf club head according to claim 12 wherein said screw means comprises at least one screw.

14. A golf club head according to claim 13 wherein said screw means further comprises at least one hollow screw receptacle fixedly disposed within said club head body.

15. A golf club head according to claim 14 wherein said at least one hollow screw receptacle is threaded to receive said at least one screw.

16. A golf club head according to claim 1 wherein said vibration damping member which is composed of a material having the characteristics of possessing an adhesive surface, of curing and of forming a connective bond between said vibration damping member and said club head body.

17. A golf club head according to claim 13 wherein said club head body comprises a sealed hollow shell.

18. A golf club head according to claim 17 wherein said club head body further comprises an encasing material disposed within an interior of said sealed hollow shell.

19. A golf club head according to claim 18 wherein said encasing material is foam plastic.

20. A golf club head according to claim 17 wherein said golf club body further comprises a removable sole plate and an upper body portion, wherein said vibration damping member is disposed between said removable sole plate and said upper body portion.

21. A golf club head according to claim 1 further comprising a means for attachment to a golf club shaft.

22. The golf club head according to claim 1 wherein said vibration member intersects at least one of said walls.

23. The golf club head according to claim 1 wherein said vibration damping member comprises a sac filled with a shock-absorptive material.

24. The golf club head according to claim 1 wherein said club head body further comprises a hollow metal shell filled with an encasing material, wherein said cavity extends through said encasing material, and wherein said encasing material substantially surrounds said vibration damping member.

25. The golf head club according to claim 1 wherein said outer walls comprise a bottom or sole plate wall and a top wall lying in generally parallel planes to each other, and said vibration damping member is disposed generally medially and parallel with respect thereto.

26. The golf club head according to claim 1 containing plural cavities within said club head body.

27. A metal wood-type golf club head having a club head body comprising:

a hollow metal shell having a plurality of walls with outer surfaces and with inner surfaces that define an inner chamber, including:

a striking face wall to address a ball during a golf club stroke, and a bottom wall adapted to pass adjacent the ground during the golf club stroke; and a shock-absorptive vibration damping member, disposed within the inner chamber of said club head body;

wherein said vibration damping member has a first planar surface, an opposing second planar surface, and a peripheral edge connecting said first and second planar surfaces; and wherein both the first and second planar surfaces lie within said club head body in a position other than adjacent any of said walls.

28. The golf club head according to claim 27 wherein said club head body further comprises an encasing material disposed within the inner chamber of said hollow metal shell, and wherein said encasing material at least partially surrounds said vibration damping member.

29. The golf club head according to claim 27 wherein at least a portion of the peripheral edge of said vibration damping member contacts at least one of the walls of said shell.

30. The golf club head according to claim 27 wherein at least a portion of said first planar surface and at least a portion of said second planar surface simultaneously contact said shell.

* * * * *